United States Patent [19]

Martenson

[11] 4,426,992

[45] Jan. 24, 1984

[54] FREE STANDING STOVE

[76] Inventor: Donald S. Martenson, 24430 S. Highway 99E, Canby, Oreg. 97013

[21] Appl. No.: 383,255

[22] Filed: May 28, 1982

Related U.S. Application Data

[62] Division of Ser. No. 165,046, Jul. 1, 1980, Pat. No. 4,359,040.

[51] Int. Cl.[3] ..... F24C 1/14

[52] U.S. Cl. ..... 126/77; 126/163 R; 126/245; 126/290

[58] Field of Search ..... 126/77, 15 R, 15 A, 126/242, 245, 146, 163 R, 163 A, 67, 108, 83, 290, 69, 112, 243, 285 R, 289

[56] References Cited

U.S. PATENT DOCUMENTS

| | | | |
|---|---|---|---|
| 99,100 | 1/1870 | Moore | 126/58 |
| 1,561,497 | 11/1925 | Wier | 126/77 |
| 1,644,900 | 10/1927 | Sperry | 126/77 |
| 4,127,100 | 11/1978 | Baker | 126/66 |
| 4,184,473 | 1/1980 | McIntire | 126/77 |
| 4,201,185 | 5/1980 | Black | 126/15 R |
| 4,215,669 | 8/1980 | Kerch | 126/112 |
| 4,224,921 | 9/1980 | Petrescue | 126/121 |
| 4,377,153 | 3/1983 | Flagg | 126/77 |
| 4,383,517 | 5/1983 | Gillis | 126/163 R |
| 4,392,477 | 7/1983 | Milligan | 126/163 R |

OTHER PUBLICATIONS

Definance Company, Masters Choice Brochure, 1980, FHZ-64056-480.

Defiance Company, Defiance Digest, vol. 1, No. 3.

Bosca Industries of New Zealand, Advertisement, N. Z. Patent Application 179,548.

*Primary Examiner*—Daniel J. O'Connor

*Attorney, Agent, or Firm*—Klarquist, Sparkman, Campbell, Leigh & Whinston

[57] ABSTRACT

A free standing stove is provided which includes a firebox for initiating the combustion of fuel, and a secondary combustion chamber for continuing the combustion. A first conduit is provided for conveying air through a draft inlet damper and into the firebox. A second conduit is provided for conveying air into the secondary combustion chamber. A third conduit conveys the gasses of combustion from the secondary combustion chamber and out of the stove. A fourth conduit may also be included which would be mounted in thermal contact with the third conduit, the fourth conduit including a lower end and an upper end and being adapted to receive ambient air in its lower end and warm the air prior to discharging it out of the upper end.

2 Claims, 7 Drawing Figures

FREE STANDING STOVE

This is a division of application Ser. No. 165,046, filed July 1, 1980, now U.S. Pat. No. 4,359,040.

BACKGROUND AND SUMMARY OF THE INVENTION

This invention relates to free standing stoves in which heat from the stove may be used to heat the air in a room and/or to cook food. Such stoves are traditionally designed to use wood or coal as fuel, although other combustible solids may alternatively be used.

Free standing wood and coal burning stoves were used for many years prior to the advent of electricity and the widespread use of fuel oil and natural gas. The term "free standing" as used herein is intended to define the type of stove which is complete in and of itself. For example, it need not necessarily be positioned within or be used in combination with any other type of stove or fireplace. It may be advantageous in some instances, however, to utilize a fireplace flue stack in the event the stove is going to be positioned in the vicinity of a fireplace.

Stoves of this type are intended to burn the fuel as completely as possible and transmit the heat released thereby into the room or dwelling. Early stoves were often constructed of cast iron or other metals which were capable of absorbing and subsequently releasing large amounts of heat. Wood and coal burning stoves have thus historically relied primarily upon radiation of heat from the stove into the immediately surrounding air space. While such stoves were acceptable to the early pioneers who lived in small dwellings and had abundant, free fuel close at hand, shortcomings became apparent as civilization and technology progressed. Specifically, the inefficient design of early stoves resulted in most of the heat passing out through the flue stack.

Realization of the inefficiency of the early stoves led to the development of more advanced units which took advantage of natural convection of air and combustion gases through the stove. An example of this type of stove is disclosed in U.S. Pat. No. 4,127,100. This patent describes a stove having the conventional box-like shape fabricated from iron or steel plate. The stove includes a single combustion chamber or firebox in which wood is placed for burning. Draft inlets are positioned in the front of the firebox while the flue or stack is at the rear. An air duct is located toward the back of the firebox. The lower end of this air duct receives ambient air and directs it upwardly and then across the top of the firebox in a plurality of tubes before discharging the air out the front of the stove. The gasses of combustion thus contact these air tubes before they exit out the rear of the firebox. As the hot gasses pass out of the combustion chamber they are directed downwardly by a baffle plate which causes the gasses to contact the upwardly extending air duct, thus imparting heat to the air as it enters the air duct.

This design is typical of second generation wood burning stoves in that it attempts to utilize the natural convection of air and gasses through the stove. While this stove is an improvement over first generation designs, it is lacking in several respects. First, in this stove the greatest amount of combustion chamber heat is applied to the air tubes at the rear of the firebox where the ambient air is relatively cool, rather than toward the front of the firebox where the ambient air has reached its highest temperature. A second disadvantage with this stove is that means are not provided for preheating ambient air which is induced into the firebox. Perhaps this is one reason why the draft inlets are positioned in the front rather than at the bottom of the stove, thereby ensuring that the warm, rather than cool, air will be induced into the stove. However, this removal of warm air from the space to be heated defeats the purpose of even having a stove. Moreover, induction from the front provides for poor combustion of the logs in the firebox.

This last point is an important one, not only in order to economize on fuel, but also to reduce the existence of particulate and other visible emissions passing up the flue stack, which not only pollute the air but also result in soot and/or creosol buildup in the flue stack. One way to reduce these emissions while obtaining the greatest amount of energy from a given amount of fuel is to use a plurality of combustion chambers. However, multiple-chambered stoves have met with little success. One reason for the failure of such stoves heretofore is that they have not justified their additional expense with a corresponding increase in efficiency.

It is a primary object of the present invention to provide an improved free standing stove which effectively and reliably overcomes the aforementioned drawbacks and limitations of the prior art proposals.

This invention responds to the problems presented in the prior art by providing a stove with a firebox or first combustion chamber for initiating the combustion of fuel, and a secondary combustion chamber for continuing the combustion. First and second conduits are provided for conveying air to the firebox and the secondary combustion chamber, respectively. A third conduit conveys the gasses of combustion from the secondary combustion chamber.

In one preferred embodiment a draft inlet damper is included to control the flow of air into the firebox, and the second conduit is mounted to receive the air from the first conduit which bypasses the firebox. In another preferred embodiment a fourth conduit is mounted in thermal contact with the third conduit for at least a substantial portion of the length of the third conduit. The phrase "thermal contact" as used herein is intended to define a relative position between the third and fourth conduits such that heat will be conveyed from the gas in the third conduit to the air in the fourth conduit, thus ensuring that the air in the fourth conduit will be heated as it passes through the stove.

These and other objects, features and advantages of the present invention will be apparent from the following description, appended claims and annexed drawings.

DETAILED DESCRIPTION OF THE PREFERRED EMBODIMENTS

Figure 1:
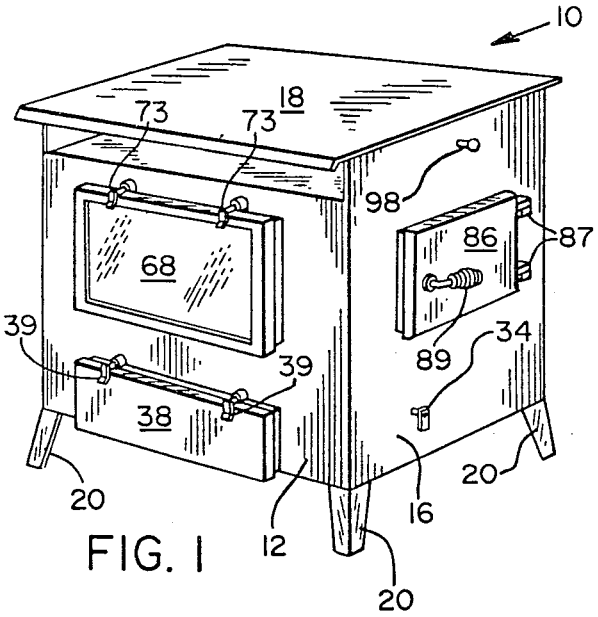
FIG. 1 is a perspective view showing the front of the stove which comprises one embodiment of the present invention.

The principles of this invention are particularly useful when embodied in a free standing stove such as that illustrated in FIGS. 1–6, generally indicated by the numeral 10. The exterior surfaces of the stove 10 include a front plate 12, a back plate 14, side plates 16 and a top plate 18. These plates are welded together to form an airtight unit. The front, back and side plates 12, 14 and 16 are typically constructed of 10-gauge steel plate, while the top plate 18 is preferably constructed of 3/16 inch steel plate. The heavier plate is desirable for the top plate 18 because of the higher temperatures typically encountered and the fact that the top plate 18 may have to support heavy pots and pans when the stove 10 is used for cooking. The stove 10 is supported by four angle iron legs 20, one of which is mounted to each corner.

Figure 3:
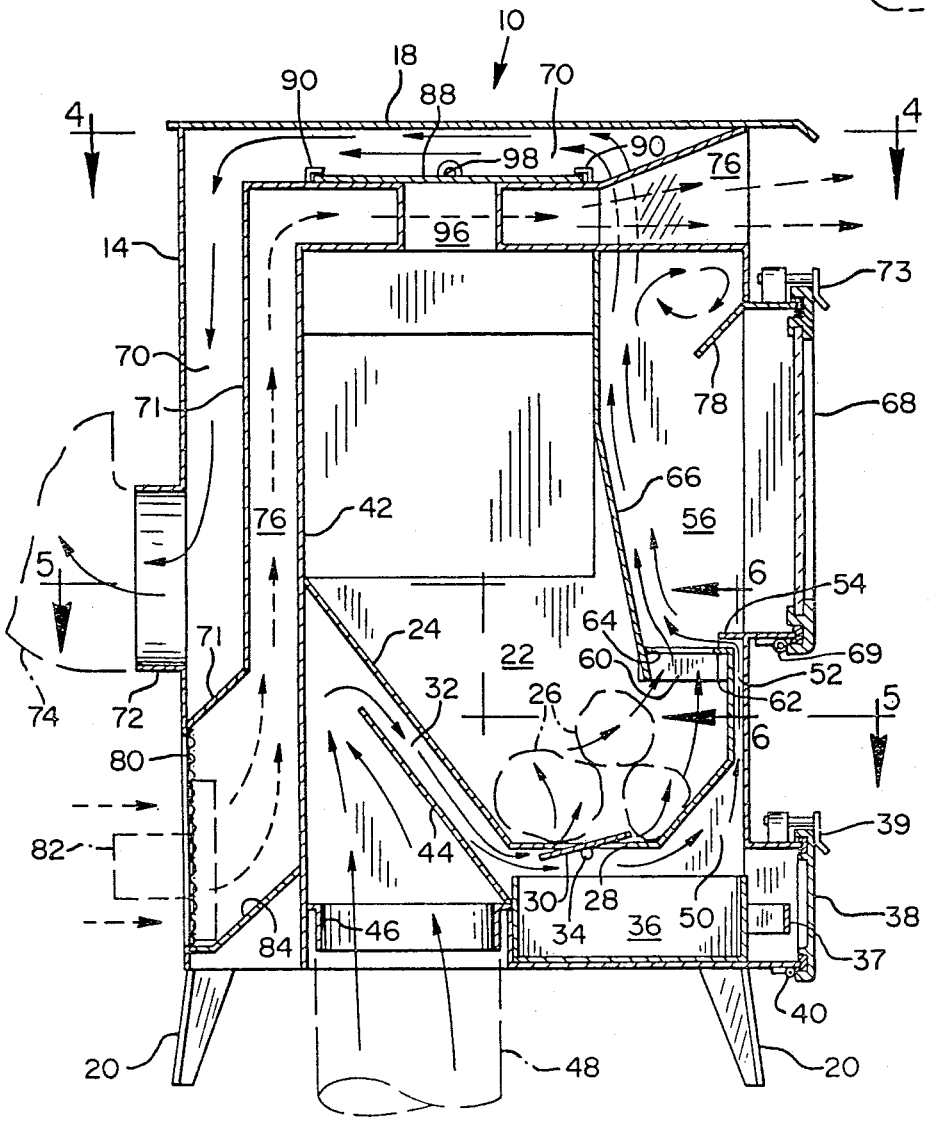
FIG. 3 is a sectional side elevation view of the embodiment of FIG. 1.

As shown best in FIG. 3, the stove 10 includes a centrally disposed firebox 22. The firebox is defined between the side plates 16 by a hearth plate 24. This hearth plate 24, typically formed from ¼ inch thick steel plate, is of such a configuration that the fuel, typically wood logs shown at 26, is concentrated in the front of the firebox 22 immediately above a draft inlet slot 28 and a draft inlet damper 30. This configuration of the hearth plate 24 permits the loading of moist or freshly-cut logs (not shown) into the firebox 22 above the logs 26 which are positioned in the lower forward portion of the firebox 22 and which are actually burning. These moist logs will thus be dried by the heat from the burning logs 26.

In the event that coal is going to be primarily used as a fuel, it may be desirable to position a grate (not shown) across the bottom of the firebox 22.

Figure 5:
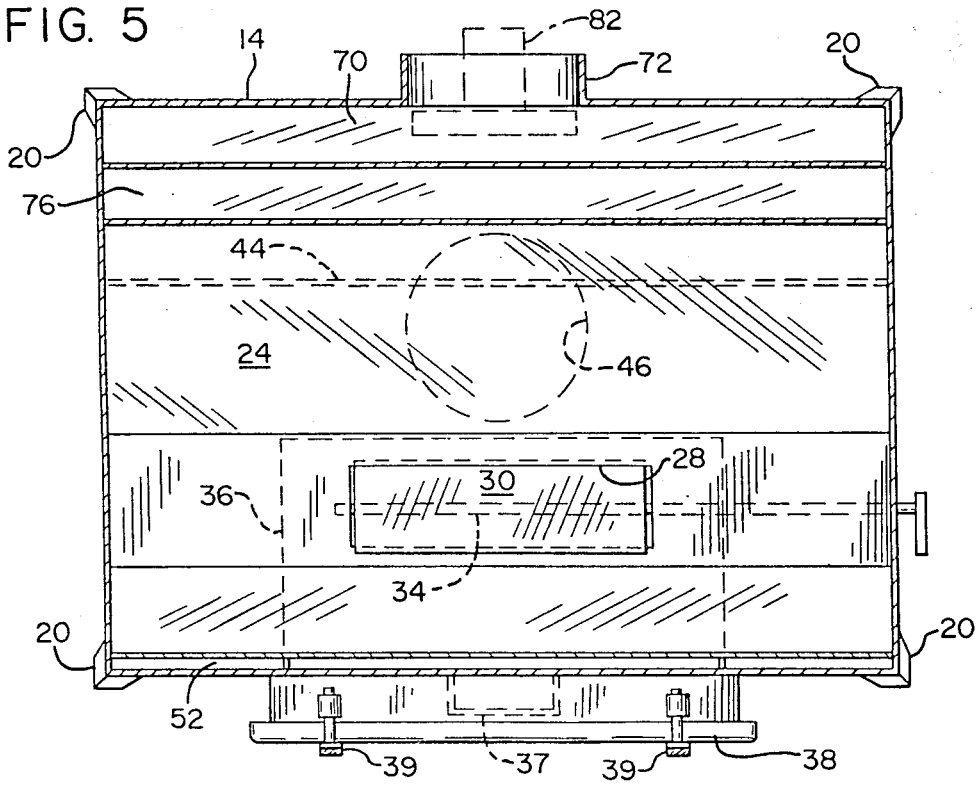
FIG. 5 is a sectional plan view taken along line 5—5 of FIG. 3.

The draft inlet damper 30, also shown in FIG. 5, controls the flow of draft air from a first conduit 32 through the draft inlet slot 28 and into the firebox 22. The draft inlet damper 30 may optionally include one or more apertures so that even when it is fully closed, a certain amount of draft inlet air will be permitted to flow into the firebox 22. This is not a preferred feature, however, so it is not depicted in the figures. It may also be desirable in certain applications to include a plurality of aligned draft inlet dampers. Normally, however, one is sufficient so only one damper is included in the depicted embodiments.

The draft inlet damper 30 is mounted to a control shaft 34 which extends out the side of the stove 10 to permit the operator to vary the position of the first damper 30, and thereby control the rate of introduction of draft air into the firebox 22. A locking wing nut (not shown) or other means may optionally be included to permit the control shaft 34 and the draft inlet damper 30 to be locked in position.

The position of the draft inlet slot 28 is such that ash and other byproducts of combustion will tend to drop downwardly into an ash receptacle 36 positioned immediately below the draft inlet slot 28 when the draft inlet damper 30 is open. This ash receptacle 36 includes a handle 37 and is generally in the shape of a drawer which may be removed through an access door 38 in the front of the stove 10. This access door 38 is hinged along its lower edge at 40 and, when closed through the use of closure dogs 39, fits snugly to prevent the leakage of ash and/or heat therethrough.

This first conduit 32 takes draft air from the underside of the stove 10 and, as shown by the solid arrows in FIG. 3, passes the draft air upward past a separator plate 42 which extends upward from the bottom of the stove 10, and around a first baffle plate 44 before directing it downwardly along the outer surface of the hearth plate 24 and through the draft inlet slot 28 into the firebox 22. The purpose of the first baffle plate 44 is twofold. First, in passing the draft air along the outer surface of the hearth plate 24, the draft air is peheated, thus increasing the efficiency of the burning taking place within the firebox 22. Second, the first baffle plate 44 prevents the possibility of hot debris dropping from the firebox 22 out the bottom of the stove 10.

It may be desirable in some applications to position the draft inlet damper across the first conduit, rather than at the bottom of the firebox (not shown). Alternatively, an additional damper might be positioned across the first conduit (not shown). In either case, the operator would be able to control the flow of draft air both into the firebox 22 and past it for reasons to be explained below.

The first conduit 32 includes a duct adapter 46 at its lower end designed to receive a draft air duct 48 which preferably would be mounted to the stove 10. The draft air duct 48 is not necessary if ambient room air, rather than outside air, is to be introduced as draft air into the stove 10.

As shown in FIG. 3, some of the draft air passing through the first conduit 32 bypasses the draft inlet slot 28 to the firebox 22. This is particularly true when the draft inlet damper 30 is only slightly open. One advantage of the flow of draft air through the first conduit 30 and beyond is that a continuous blanket of moving air is provided to insulate the underside of the firebox 22. This permits the stove 10 to be positioned directly over carpet or other floor coverings which might have a tendency to burn or scorch in the presence of conventional stoves.

The draft air which has bypassed the firebox 22 is directed via a second conduit 50 upward through a narrowed section 52 and past a second baffle plate 54 into a secondary combustion chamber 56. The constriction in the narrowed section 52 of the second conduit 50 results in an increase in velocity in the draft air which, in combination with the disruption in flow caused by the second baffle plate 54, causes a significant amount of turbulence as the draft air mixes with hot gasses of combustion passing upward into the secondary combustion chamber 56 from the firebox 22. It may be desirable under certain conditions that the position of the second baffle plate 54 be adjustable in order to vary the velocity, angle and/or rate of introduction of draft air into the secondary combustion chamber 56. Such adjustability could be provided by the addition of a hinge (not shown) or other conventional movable mounting means.

Figure 6:
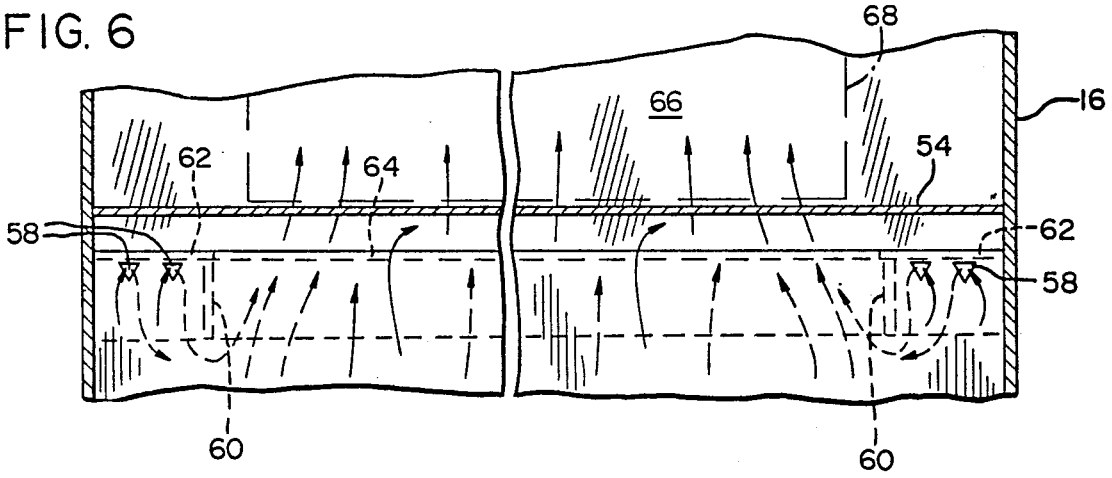
FIG. 6 is a partial sectional front elevation view taken along line 6—6 of FIG. 3.

As shown in FIG. 6, a plurality of aligned apertures 58 are located in the uppermost, front edge of the hearth plate 24 so that a certain amount of draft air is permitted to mix with the gasses of combustion before they actually enter the secondary combustion chamber 56. FIG. 6 also shows two side baffles 60 which are mounted to the underside of the secondary combustion chamber bottom plate 62. This bottom plate 62 extends inwardly from each side plate 16 to the side baffles 60, but between the side baffles 60 merely serves to define the combustion gas inlet 64 to the secondary combustion chamber 56. The side baffles 60 in cooperation with the bottom plate 62 force the combustion gasses and the draft air passing through the apertures 58 toward the center of the stove 10. This is desirable for reasons to be described below.

As shown in FIG. 3, the draft air rising up through the second conduit directs the hot combustion gasses against the rear wall 66 of the secondary combustion chamber 56. This is desirable to minimize the transmission of heat to the tempered glass inspection door 68. This inspection door 68 is desirable to permit the flames within the secondary combustion chamber 56 to be visible from outside the stove 10. The inspection door 68 is typically mounted by a hinge 69 to permit it to be opened for cleaning. It can be locked in the closed position through the use of pivotable closure dogs 73.

The combustion gasses rising out of the secondary combustion chamber 56 pass into a third conduit 70 which is initially defined between the rear wall 66 of the secondary combustion chamber 56 and the front plate 12 of the stove 10. The third conduit follows the outer surfaces of the stove 10 past the top plate 18 and the back plate 14, where it is defined between the back plate 14 and a third conduit plate 71. The gasses then are directed into a flue 72 and up out of the stove 10 through a flue stack 74. In some applications it may be desirable to mount the flue stack toward the back of the top of the stove. This is not a preferred embodiment, however, and is therefore not depicted.

Figure 4:
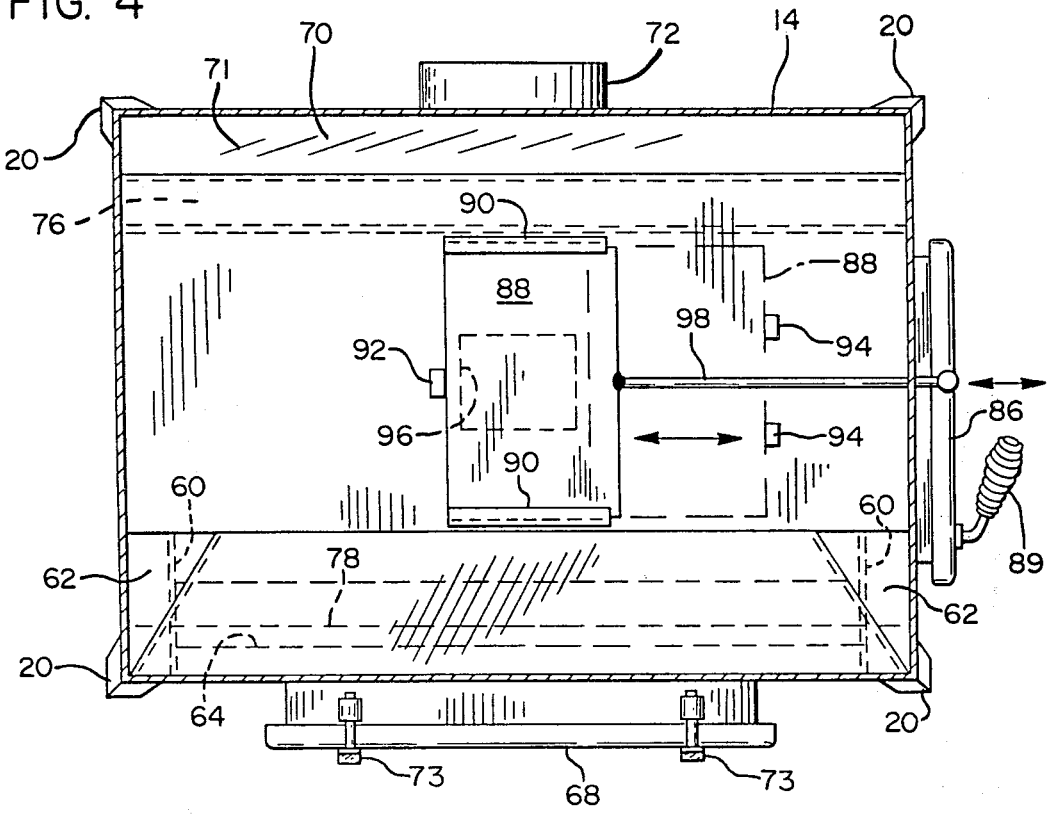
FIG. 4 is a sectional plan view taken along line 4—4 of FIG. 3.

Immediately after the third conduit 70 receives the combustion gasses from the secondary combustion chamber 56, the flow of the gasses is disrupted by a fourth conduit 76 which extends across and through the third conduit 70. As will be described more fully below, the fourth conduit 76 conveys ambient air through the stove 10 prior to discharging it out the front of the stove. As the rising combustion gasses contact the underside of the fourth conduit 76, they are disrupted, causing a slight swirling as shown in FIG. 4. A shield plate 78 extends diagonally inward from the front plate 12 in order to prevent the swirling gasses from contacting the inspection door 68.

As mentioned above, the embodiment of FIGS. 1–6 includes a fourth conduit 76. This fourth conduit 76 takes ambient air in through a screen 80 in the back of the stove 10. The passage of the ambient air through the fourth conduit 76 is illustrated in FIG. 3 by broken lines and arrows, thereby distinguishing the air from the combustion gasses and draft air shown in solid lines. A fan 82 is included in the depicted embodiment to accelerate the flow of air into and through the fourth conduit 76. While the fan 82 increases the heat output of the stove 10, it is not absolutely necessary since the heated air will automatically rise through the fourth conduit 76 by natural convection. In the event a fan 82 is included, air direction plate 84 is positioned immediately in front of the fan 82 to redirect the ambient air from a horizontal to a vertical direction.

As illustrated, the fourth conduit 76 extends upwardly, across the top end of the firebox 22 and then through the third conduit, before discharging the now-warmed ambient air out of the stove 10. As shown in FIGS. 3 and 4, the fourth conduit diverges outwardly and upwardly as it passes through the third conduit. This configuration permits the natural expansion of the air as it is heated by the hot combustion gasses. Since the fourth conduit 76 is centered within the third conduit 70, and the combustion gasses tend to be centered by the bottom plate 62 of the secondary combustion chamber 56 and the side baffles 60, this configuration maximizes the disruption of the flow of the combustion gasses, thereby increasing the transmission of heat to the ambient air.

Figure 2:
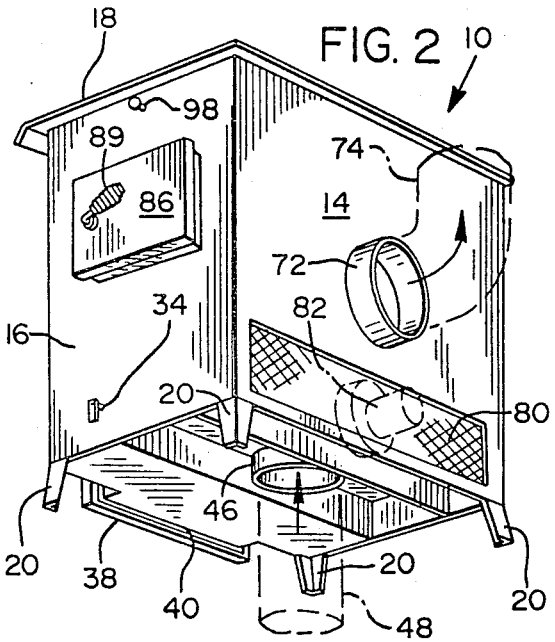
FIG. 2 is a perspective view of the embodiment of FIG. 1, showing the underside and rear of the stove.

As shown in FIGS. 1 and 2, the stove 10 includes a firebox access door 86 which is mounted to one of the side plates 16 by hinges 87 or similar connection which permits the firebox access door 86 to be opened. Through this door the operator can achieve access to the firebox 22 for adding fuel, cleaning, etc. The firebox access door 86 can be closed and locked by rotating a handle 89 which is mounted to a conventional, concealed lever (not shown).

A slidably mounted bypass plate 88 is mounted between a pair of aligned angle iron runners 90 in the upper part of the stove 10. Closing and opening stops 92 and 94, respectively, are provided to prevent dislodgement of the bypass plate 88 from the runners 90. A control rod 98 extends out the side of the stove 10 to permit the operator to control the position of the bypass plate 88. The bypass plate 88 is mounted immediately above a bypass conduit 96, which is shown in cross section in FIG. 4 and in elevation in FIG. 3. When the bypass conduit 96 is opened, combustion gasses are permitted to flow up the top of the firebox 22, through the bypass conduit 96 and into the third conduit 70, thus bypassing the secondary combustion chamber 56. It is desirable to open the bypass conduit 96 when the stove 10 is being lit and at any other time the firebox access door 86 is open. This ensures that the combustion gasses pass into the third conduit 70 and out the flue 72 rather than out the firebox access door 86. For this reason, it may be desirable in certain applications to link the bypass plate 88 and the firebox access door 86 to automatically retract the former when the latter is opened. This linkage would be of conventional design and therefore is not depicted.

While it is believed that the above description taken in conjunction with the appended drawings, renders this first preferred embodiment clear to one with ordinary skill in the art, the complete operation of this embodiment will now be described. Prior to lighting the stove 10, it should be determined whether an adequate supply of logs, coal or other fuel is in the firebox 22. This can be ascertained through the firebox access door 86. Additional fuel can be added if needed through the firebox access door 86. The operator should also ascertain, through the ash receptacle access door 38, whether the ash receptacle 36 needs to be emptied. If so, this can be done through the ash receptacle access door 38. Prior to lighting the stove 10, the bypass plate 88 should be pulled outward until the bypass plate 88 contacts the opening stops 94, thus opening the bypass conduit 96. The draft inlet damper 30 is then opened by turning the control shaft 34, thus permitting draft air to flow into the firebox 22. The logs 26 or other fuel may then be lit through the firebox access door 86. Any combustion gasses generated during the lighting process will pass through the bypass conduit 96, into the third conduit 70, and out the flue 72, due to the inherent induction of the gasses up the flue stack 74. Once the fire is going and the firebox access door 86 is closed, the bypass conduit 96 may be closed by pushing in the control rod 96 until the bypass plate 88 comes into contact with the closing stop 92.

When the bypass conduit 96 is closed, the combustion gasses will pass from the firebox 22 up into the secondary combustion chamber 56, where they are thoroughly mixed with draft air which has bypassed the draft inlet slot 28 and passed through the second conduit 50 and its narrowed section 52, thus increasing its velocity before being directed at a right angle by the second baffle plate 54 into the stream of combustion gasses. A portion of the draft air passes through the apertures 58 in the upper edge of the hearth plate 24, thus directly mixing with the combustion gasses before they enter the secondary combustion chamber 56. This draft air and the combustion gas is directed inwardly by the side baffles 60 and the bottom plate 62 of the secondary combustion chamber 56 which is closed at its sides.

The turbulence resulting from the introduction of the accelerated stream of draft air into the stream of hot combustion gasses passing into the secondary combustion chamber 56 results in a thorough mixing of the two streams. this causes combustion of the preheated, gasified fuel to continue, thus greatly adding to the completeness and thus the efficiency of the combustion. This not only results in an increase in the amount of heat released by the stove per unit of fuel, but also burns most of the emissions which would otherwise be discharged up the flue stack 74.

The combustion gasses passing from the secondary combustion chamber 56 into the third conduit 70 are directed against the fourth conduit 76 extending across in the path of the combustion gasses. Only a small proportion of the gasses pass directly by the fourth conduit 76, but even those gasses impart heat to the side walls of the fourth conduit 76. the reason for this is because the combustion gasses were directed laterally inward by the side baffles 60 and the bottom plate 62 of the secondary combustion chamber 56. Eventually, all of the combustion gasses pass around the fourth conduit 76, and across the top of the stove 10 immediately below the top plate 18. This heats the top plate 18, radiating heat into the ambient air and providing a hot surface for cooking. At the same time, the combustion gasses are providing heat to the air in the fourth conduit 76. This continues as the combustion gasses are directed downwardly to the flue 72.

If a substantial amount of heat is required from the stove 10, the fan 82 may be energized. Alternatively, a thermostat (not shown) may be used to regulate energization of the fan 82. However, even without the fan 82, ambient air will enter the lower end of the fourth conduit 76 and pass upwardly between the third conduit 70 and the separator plate 42, thus being heated from both sides. This continues until the fourth conduit 76 extends across the third conduit 70, where the hottest combustion gasses come into contact with it. The present invention is thus a dramatic improvement over prior art designs since most of the heat is imparted to the ambient air when it is at its highest temperature, i.e., immediately before it leaves the stove 10. The cooler combustion gasses which are about to pass out the flue 72 initiate the heating process. Thus, at all times, the temperature difference between the combustion gasses and the ambient air is kept at a minimum.

Figure 7:
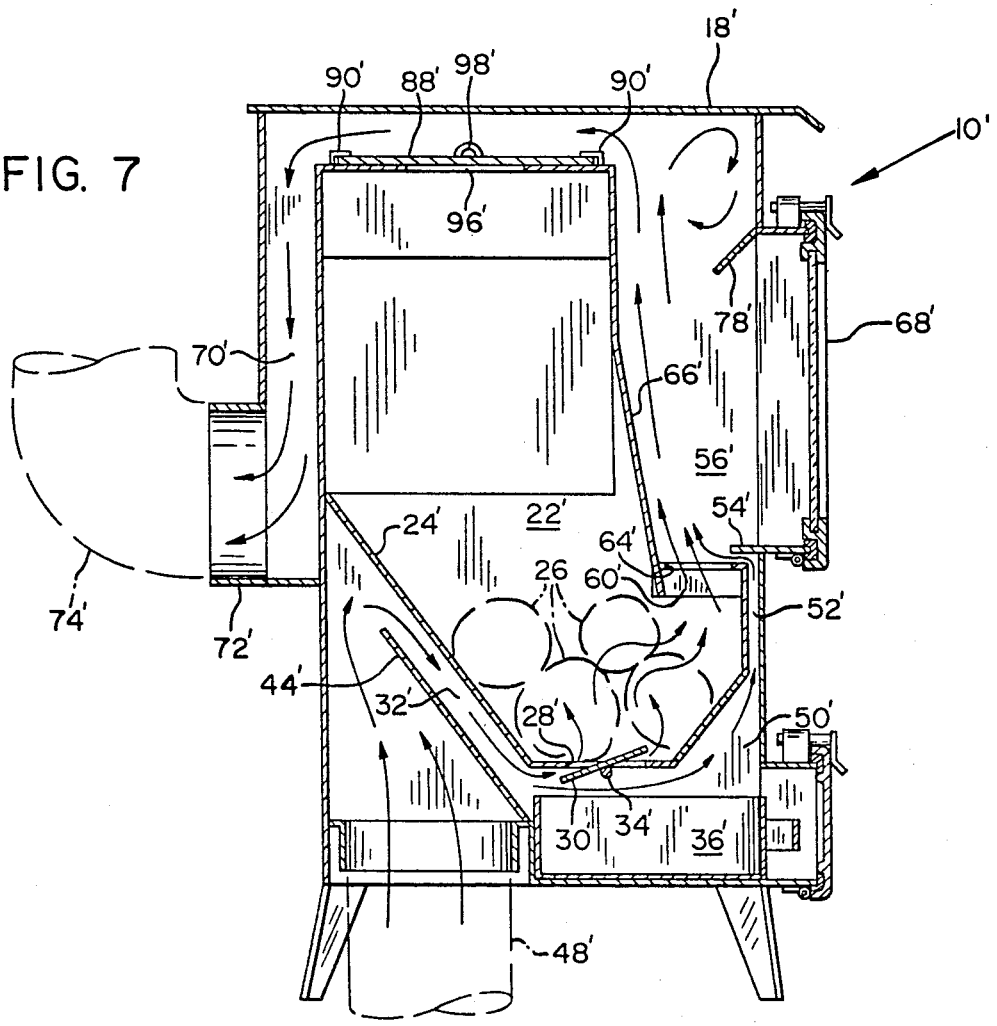
FIG. 7 is a sectional side elevation view of a second embodiment of the present invention.

A second embodiment of the present invention is depicted in FIG. 7, and is identified with the numeral 10'. The basic difference between this stove 10' and that previously described is that a fourth conduit, which circulates ambient air through the stove 10, is not included. Thus, this stove 10' relies solely upon radiation of heat into the ambient air rather than the combination of such radiation with natural convection. This stove 10' includes all of the elements of the previously described stove 10, and these elements have been identified in FIG. 7 with corresponding numerals except that they have been primed.

In this second embodiment of the stove 10' the draft air passes via the draft air duct 48' and the first conduit 32', either through the draft inlet damper 30' and the draft inlet slot 28' into the firebox 22', or past the draft inlet slot 28' and into the secondary combustion chamber 56'. The second baffle plate 54' directs this draft air at right angles against hot combustion gasses rising through the combustion gas inlet 64'. The turbulent combustion gasses and draft air are thus directed against the rear wall 66' of the secondary combustion chamber 56', where the combustion continues The resulting combustion gasses rise past the inspection door 68' and the shield plate 78' and into the third conduit 70'. As the combustion gasses pass through the third conduit 70' they impart heat to the top plate 18', which radiates heat into the room. The combustion gasses then pass out the flue 72' and the flue stack 74'.

When the stove 10' is being lit and at any other time the firebox access door is open, the bypass plate 96' is retracted. This is done in the same way as with the first embodiment 10; that is, the control rod 98' is pulled, which causes the bypass plate 96' to slide outwardly in the angle iron runners 90'. This permits combustion gasses to flow upwardly from the firebox 22' directly into the third conduit 70', thus bypassing the secondary combustion chamber 56'. When the firebox access door is closed, the bypass plate 96' is pushed back to its original position, thus sending the combustion gasses from the firebox 22' into the secondary combustion chamber 56'.

Of course, it should be understood that various other changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A free standing stove comprising:

a firebox for initiating the combustion of fuel, said firebox including a bottom with a draft inlet therein;

a first conduit for conveying air to said draft inlet;

a draft inlet damper disposed in said draft inlet for controlling the flow of the air from said first conduit into the bottom of said firebox and for permitting combustion by-products to drop downwardly through said draft inlet damper and out of said firebox;

a secondary combustion chamber for continuing the combustion, said secondary combustion chamber receiving the gasses of combustion from said firebox and further oxidizing the gasses, said secondary combustion chamber including a lower portion;

a second conduit for conveying air into said lower portion of said secondary combustion chamber, said second conduit receiving air from said first conduit; and a third conduit for conveying the gasses of combustion from said secondary combustion chamber.

2. The stove of claim 1 wherein said draft inlet damper comprises a plate mounted to pivot with a shaft extending medially along said draft inlet.

* * * * *